US009422781B1

(12) United States Patent
Bennett

(10) Patent No.: US 9,422,781 B1
(45) Date of Patent: Aug. 23, 2016

(54) MAGNETIC TOOL AND METHOD

(71) Applicant: Robert W. Bennett, McKinney, TX (US)

(72) Inventor: Robert W. Bennett, McKinney, TX (US)

(73) Assignee: Lone Star Magnetics, LLC, Sherman, TX (US)

( * ) Notice: Subject to any disclaimer, the term of this patent is extended or adjusted under 35 U.S.C. 154(b) by 0 days.

(21) Appl. No.: 14/921,201

(22) Filed: Oct. 23, 2015

Related U.S. Application Data

(60) Provisional application No. 62/067,670, filed on Oct. 23, 2014.

(51) Int. Cl.
*E21B 31/06* (2006.01)
*B25J 15/06* (2006.01)

(52) U.S. Cl.
CPC ..... *E21B 31/06* (2013.01); *B25J 15/0608* (2013.01)

(58) Field of Classification Search
CPC ..... E21B 31/06; E21B 37/00; B25J 15/0608
USPC ..... 294/65.5, 86.1; 166/66.5
See application file for complete search history.

(56) References Cited

U.S. PATENT DOCUMENTS

| | | | | |
|---|---|---|---|---|
| 3,307,716 | A * | 3/1967 | Ross | B65G 1/14 271/193 |
| 4,407,038 | A * | 10/1983 | Haase | B03C 1/30 15/105 |
| 5,624,146 | A * | 4/1997 | De Los Reyes | A47L 13/41 209/215 |
| 6,216,787 | B1 | 4/2001 | Ruttley | |
| 6,439,303 | B1 | 8/2002 | Sorhus et al. | |
| 6,491,117 | B2 * | 12/2002 | Ruttley | E21B 31/06 166/66.5 |
| 6,655,462 | B1 * | 12/2003 | Carmichael | E21B 31/06 166/173 |
| 6,677,846 | B2 * | 1/2004 | Snider | H01F 7/0257 294/65.5 |
| 7,219,724 | B2 | 5/2007 | Theriot | |
| 2010/0181064 | A1 * | 7/2010 | Knobloch | E21B 27/00 166/99 |
| 2011/0284210 | A1 * | 11/2011 | Hern | E21B 17/1078 166/99 |
| 2015/0122480 | A1 | 5/2015 | Sullivan et al. | |

* cited by examiner

*Primary Examiner* — Dean Kramer
(74) *Attorney, Agent, or Firm* — Keith E. Taber

(57) ABSTRACT

A magnetic tool for use in removing metal debris from a well is disclosed, the tool having inserts that may be safely installed and removed by a method using a placement screw to prevent pinching. The inserts comprised of a sleeve with a lead end and a follow end. The inserts also containing a plurality of magnets.

11 Claims, 5 Drawing Sheets

MAGNETIC TOOL AND METHOD

BACKGROUND

1. Field of the Invention

The present invention relates generally to tools and methods used to remove metal from wells.

2. Description of Related Art

During a drilling process metal debris is often formed within a well. Where that debris is magnetic, typically from being sufficiently ferrous, it may be removed by placing a tool having magnets within the well. The magnet will attract the magnetic debris from within the well, especially if that debris is dispersed in fluids within the well. Removal of the magnetic debris can reduce processing costs of fluids that are removed form the well and aid production from the well in other ways generally known in the art.

The tools currently used either have multiple small magnets or large magnetic inserts. Either way the magnets have to be secured to the tools to insure that they survive the trip down the well and back up in an environment of extreme temperature and pressure. Upon removal of the tool from the well the magnets typically are removed from the tool for cleaning and inspection before being used again. Where the magnets are arranged in large inserts they are very powerful and can be difficult and dangerous to install and remove from the tools. There is a high risk of pinching skin or body parts when dealing with these powerful magnet inserts.

A need exists, therefore, for a magnetic tool with powerful magnet inserts that are safe to install and remove from a tool, an insert to help achieve this goal and a method for safely installing and removing inserts from a magnetic tool.

All references cited herein are incorporated by reference to the maximum extent allowable by law. To the extent a reference may not be fully incorporated herein, it is incorporated by reference for background purposes and indicative of the knowledge of one of ordinary skill in the art.

BRIEF SUMMARY OF THE INVENTION

The problems presented in the art are addressed by a magnetic insert for a magnetic tool used in a well, the insert comprising: a tubular sleeve with a first end and a second end opposite the first end, an outwardly facing top surface and an inwardly facing bottom surface; a lead end securely attached to the first end; a follow end securely attached to the second end; a plurality of magnets within the sleeve, each magnet having a north pole and an opposite south pole, the magnets arranged in the sleeve such that each magnet has the same pole directed towards the top surface; and the follow end having a smooth bore for receiving a securing bolt and a threaded bore for receiving a placement bolt.

The problems presented in the art are addressed by a tool for removing metal from a well, the tool comprising: a body having a connector at a top end of the body and a plurality of recesses about a perimeter of the body, each recess having a tool tab at one end; a plurality of magnetic inserts sized to fit the recesses, each insert comprising: a tubular sleeve with a first end and a second end opposite the first end, an outwardly facing top surface and an inwardly facing bottom surface; a lead end securely attached to the first end; a follow end securely attached to the second end; a plurality of magnets within the sleeve, each magnet having a north pole and an opposite south pole, the magnets arranged in the sleeve such that each magnet has the same pole directed towards the top surface; and the follow end having a smooth bore for receiving a securing bolt and a threaded bore for receiving a placement bolt and washer.

The problems presented in the art are addressed by a method for safely securing and removing magnetic inserts from a magnetic tool used in a well, the method comprising: providing a tool having: a body having a connector at a top end of the body and a plurality of recesses about a perimeter of the body, each recess having an associated tool tab at one end of the recess and an associated threaded tool bore at the opposite end; a plurality of magnetic inserts sized to fit the recesses, each insert comprising: a tubular sleeve with a first end and a second end opposite the first end, an outwardly facing top surface and an inwardly facing bottom surface; a lead end securely attached to the first end; a follow end securely attached to the second end; a plurality of magnets within the sleeve, each magnet having a north pole and an opposite south pole, the magnets arranged in the sleeve such that each magnet has the same pole directed towards the top surface; and the follow end having a smooth bore for receiving a securing bolt and a threaded bore for receiving a placement bolt and washer; threading a placement bolt through a washer and through the threaded bore in the follow end of a first magnetic insert; placing the lead end of the first insert under a first tool tab while holding the follow end of the first insert away from the tool; moving the follow end of the insert towards the recess associated with the first tool tab until the placement bolt is within the recess; unscrewing the placement bolt to lower the sleeve into the recess of the tool; unscrewing the placement bolt from the threaded hole completely; and placing a securing bolt through a washer and through the smooth bore of the follow end of the insert into the threaded tool bore associated with the first tool tab.

Other objects, features, and advantages of the present invention will become apparent with reference to the drawings and detailed description that follow.

DETAILED DESCRIPTION

All references cited herein are incorporated by reference to the maximum extent allowable by law. To the extent a reference may not be fully incorporated herein, it is incorporated by reference for background purposes and indicative of the knowledge of one of ordinary skill in the art.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical mechanical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
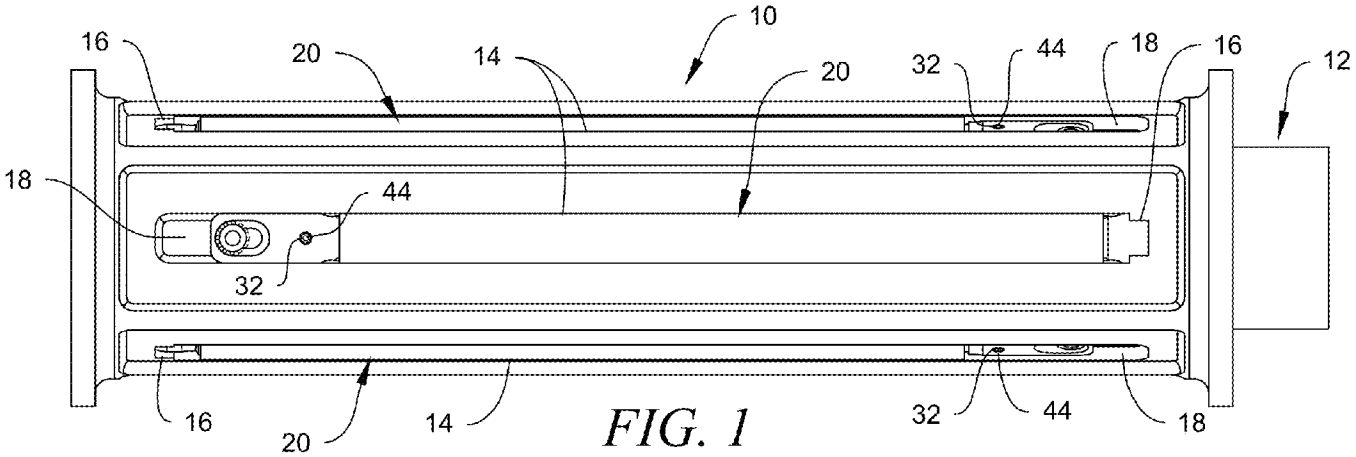
FIG. 1 is a perspective view of a tool for removing metal from a well.

FIG. 1 is a perspective view of a tool 10 for removing metal from a well. Tool 10 is lowered into a well by its connector 12 to remove metal debris, such as worn parts of bits or other tools, from the fluid in a well. Tool 10 has several recesses 14 about it perimeter running lengthwise along tool 10. Each recess 14 has a tool tab 16 at one end and a threaded tool bore 18 at the opposite end the tab 16. Each recess 14 may accommodate a magnetic insert 20.

Figure 2:
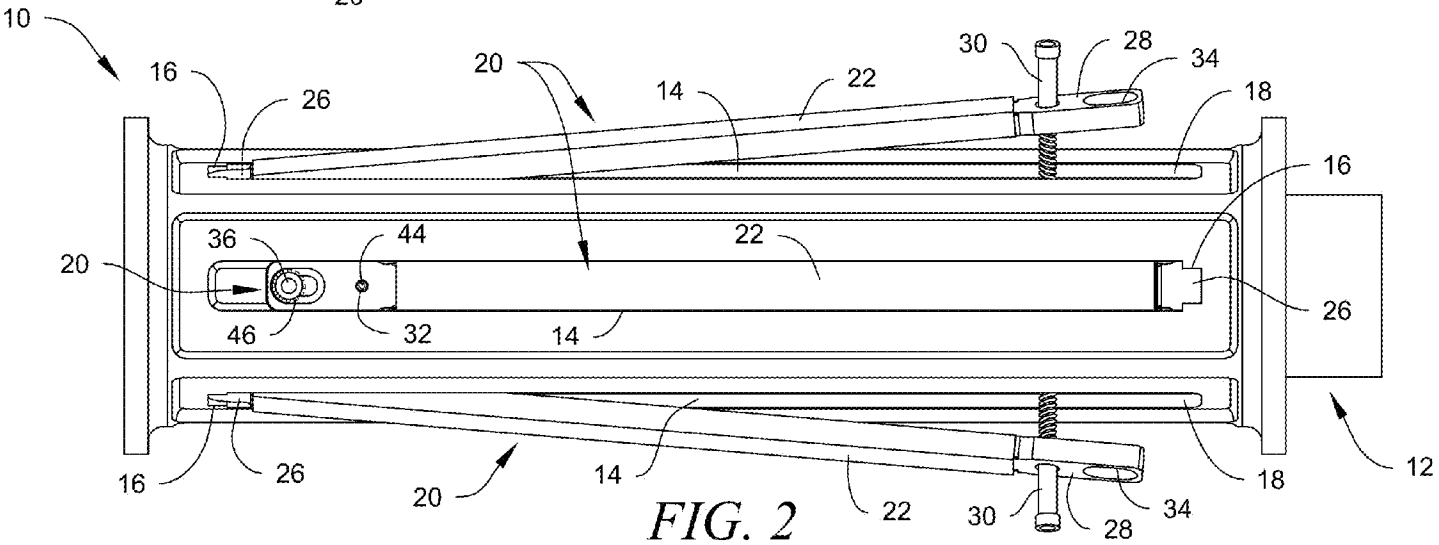
FIG. 2 is a perspective view of the tool of FIG. 1 with a magnetic insert partially installed in the tool.

FIG. 2 is a perspective view of the tool 10 of FIG. 1 with a magnetic insert 20 partially installed in the tool 10. The magnetic insert 20 has a sleeve 22 holding the magnets 24, as will be described in more detail below. The sleeve is capped at one end by a lead end piece 26 and at the opposite end by a follow end piece 28. The lead end piece 26 is positioned under tab 16 of a recess 14. The follow end piece 28 is spaced from recess 14 by a placement bolt 30. The partially removed inserts 20 may either be new inserts 20 being placed or old inserts 20 being removed, as will be discussed below.

Figure 3:
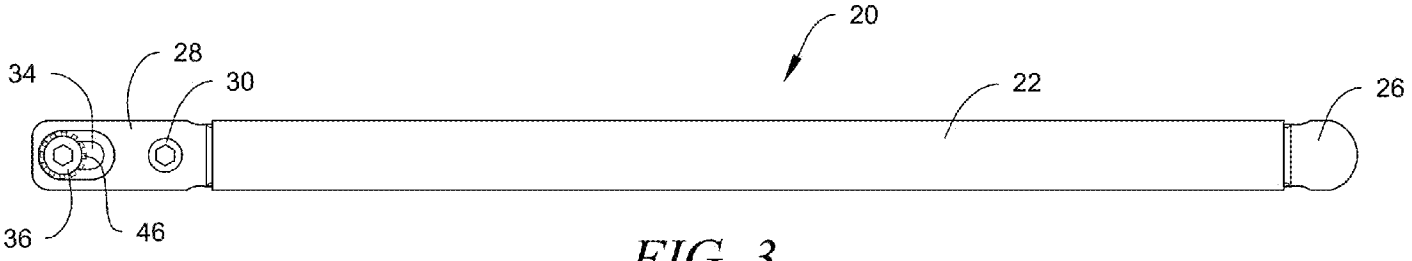
FIG. 3 is a top view of a magnetic insert from the tool of FIG. 1.

FIG. 3 is a top view of a magnetic insert 20 from the tool 10 of FIG. 1. The insert 20 has a sleeve 22 capped by a lead end piece 26 and a follow end piece 28. Lead end piece 26 may be rounded as shown to aid in placement and orientation. Follow end piece 28 has a tapped hole 32 and a smooth bored slot 34. Tapped hole 32 is threaded to receive placement bolt 30. Smooth bored slot 34 is preferably recessed to receive securing bolt 36 and washer 46. Sleeve 22 is a tube of ferromagnetic material, such as type 410 stainless steel. Lead end piece 26 and follow end piece 28 are typically formed of non-ferrous material, such as type 303 stainless steel. Lead end piece 26 and follow end piece 28 are welded to sleeve 22 to seal the sleeve.

Figure 4A:
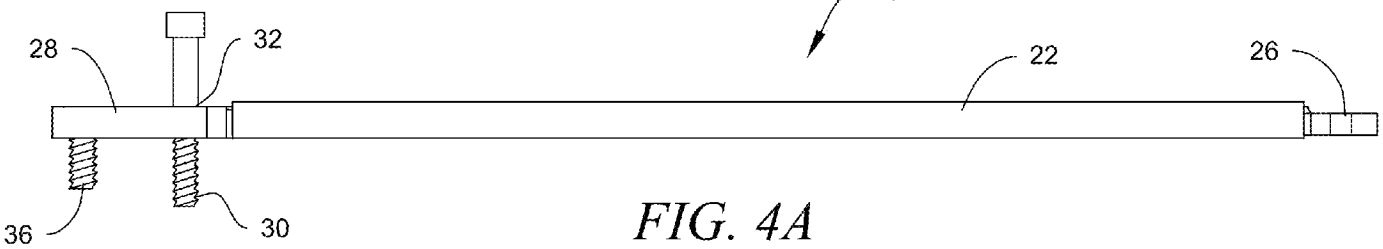
FIG. 4A is a side view of the magnetic insert of FIG. 2.

FIG. 4A is a side view of the magnetic insert 20 of FIG. 2. Lead end 26 is thinner than sleeve 20 to allow lead end 26 to fit under tab 16 as discussed above. Follow end 28 may also be thinner to reduce any interference between the securing bolt 36 and operation of the tool 10. To position insert 20 into tool 10 securing bolt 36 and washer 46 are removed and placement bolt 30 is fully threaded through tapped hole 32.

Returning to FIGS. 1 and 2, lead end 26 is placed under tab 16 of tool 10 while follow end 28 is held away from recess 14. Follow end 28 may then be lowered until placement bolt 30 is in recess 14, as shown in FIG. 2. Follow end 28 may then be tapped with a non-metallic hammer to secure lead end 26 under tab 16 in recess 14. Placement bolt 30 is then partially unscrewed from tapped hole 32 to allow follow end piece 28 to be drawn closer to recess 14 by magnets 24. Follow end 28 may then be tapped with a non-metallic hammer to further secure lead end 26 under tab 16 in recess 14. This process is repeated as necessary to lower insert 20 into recess 14 of tool 10 while keeping lead end 26 secure behind tab 16. Once placement bolt 30 is fully unthreaded follow end piece 28 will be resting in recess 14 and smooth bore 34 should be aligned with threaded tool bore 18 in recess 14. Securing bolt 36 is placed through smooth bore with washer 46 placed over the threads of the securing bold, above the unthreaded follow end piece 24 and threaded into tool bore 18 to secure follow end 28 and insert 20 into tool 10. Washer 46 is preferably a locking type to prevent backing of securing bolt 36. A setscrew 44 may be secured in tapped hole 32 to prevent debris build up in tapped hole 32 during use and further secure insert 20 as shown in FIGS. 1 and 2. Placement bolt 30 allows for insert 20 to be lowered into recess 14 without the need of a body part, such as a finger, being between insert 20 and tool 10 that could be pinched. This arrangement also has fewer parts than comparable units in the prior art to reduce loss or failure.

To remove insert 20 from tool 10 follow end 28 may first need to be wiped clear of any debris from use. Setscrew 44, if used, and securing bolt 36 and washer 46 may then be removed. Placement bolt 30 is then threaded through tapped hole 32 to lift follow end piece 28 from recess 14. Once placement bolt 30 is fully threaded through tapped hole 32 follow end 28 should be safely clear of tool 10 and insert 20 may be removed from tool 10 by sliding lead end 26 out from under tab 16.

Figure 4B:
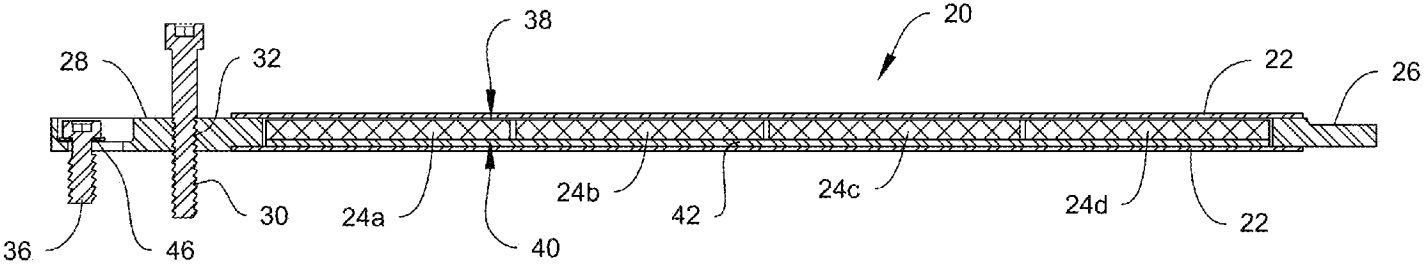
FIG. 4B is a sectional side view of the magnetic insert of FIG. 3.

FIG. 4B is a sectional side view of the magnetic insert 20 of FIG. 3. The sectional view allows magnets 24 to be shown. In this example there are 4 magnets 24 positioned within sleeve 22, although the number of magnets 24 will depend on the size of the insert. Each magnet 24 has a north pole 38 and a south pole 40. The magnets 24 are placed within sleeve 22 so that they all have the same pole facing up. For example, all of the magnets 24 may be placed into the sleeve 22 with their north poles 38 facing up as shown. Individual magnets 24 may be of various length, width and thickness dimensions. Individual magnets 24 of various thickness dimensions may consist of a single magnet 24 with a specific thickness or it may consist of two or more magnets 24 that are stacked on top of each other with the magnetic north and south poles of the stacked magnets 24 facing and contacting each other to create a thicker, more powerful magnet circuit as compared to a thinner single magnet 24 or thinner stack of magnets 24 with the thickness of magnets 24 or stack of magnets 24 being level across the entirety of the north and south poles for a consistent magnetic circuit from end to end within the sleeve 22. Magnets 24 are typically raw magnets such as Neodymium Iron Boron, Ultra High Temperature Neodymium Iron Boron, Samarium Cobalt, Ceramic, or AlNiCo. N40UH (Neodymium Iron Boron Ultra High Temperature Rated grade 40) raw magnets. 24 may be Nickel coated for corrosion prevention. SmCo26 (Samarium Cobalt grade 26) raw magnets 24 may be non-coated in some applications.

Also visible from this view is pole piece 42. Pole piece 42 has two primary functions. Pole piece 42 is placed on the bottom of sleeve 22 so that in use pole piece 42 is between magnets 24 and tool 10. Pole piece 42 aids in the assembly of insert 20 by providing a surface for loading the magnets 24 within sleeve 22. Pole piece 42 also serves to focus the magnetic field of magnets 24 out from the perimeter of tool 10. Pole piece 42 is made of ferromagnetic material, such as 1018 carbon steel.

Figure 5A:
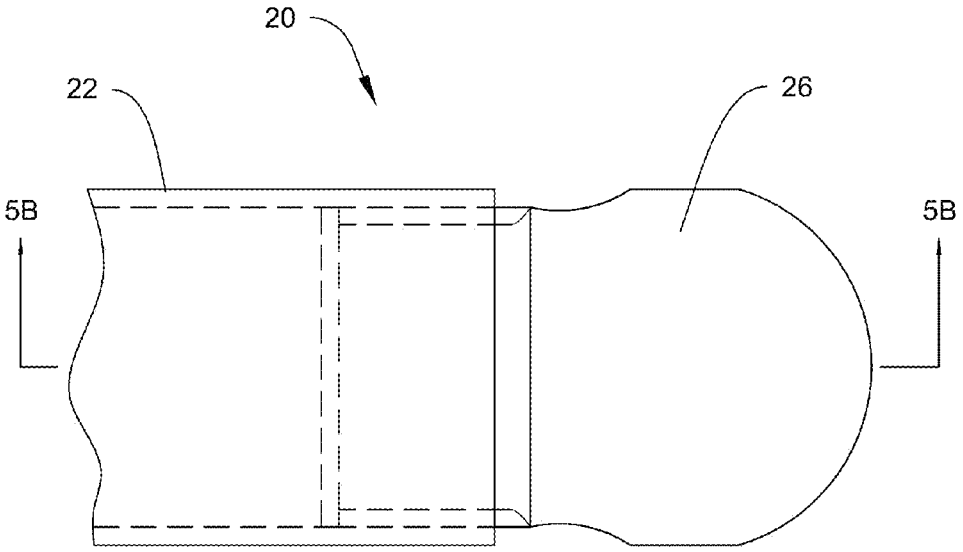
FIG. 5A is a close up view of the lead end of the insert of FIG. 3.

FIG. 5A is a close up view of the lead end 26 of the insert 20 of FIG. 3. Lead end 26 is shown inserted into sleeve 22 such that lead end 26 may be welded to seal sleeve 22. Lead end 26 is shown rounded to aid in positioning within recess 14 and under tab 16.

Figure 5B:
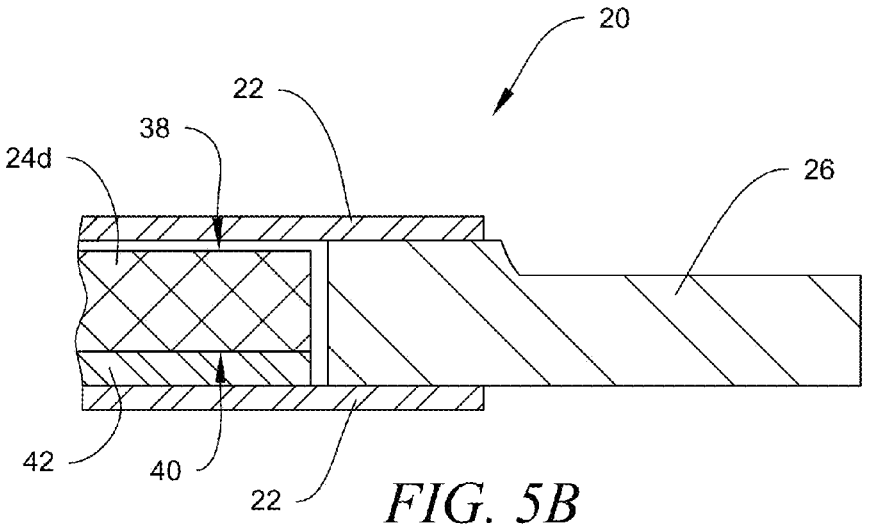
FIG. 5B is a close up view of the lead end of the insert of FIG. 4.

FIG. 5B is a sectional view of the lead end 26 of the insert 20 of FIG. 5A. Lead end 26 is shown sealing sleeve 22 with magnets 24 and pole piece 42 within sleeve 22. Lead end 26 may abut magnets 24 and pole piece 42. Pole piece 42 may be slightly shorter than magnets 24 to insure that magnets 24 are pressed tightly together within sleeve 22.

Figure 6A:
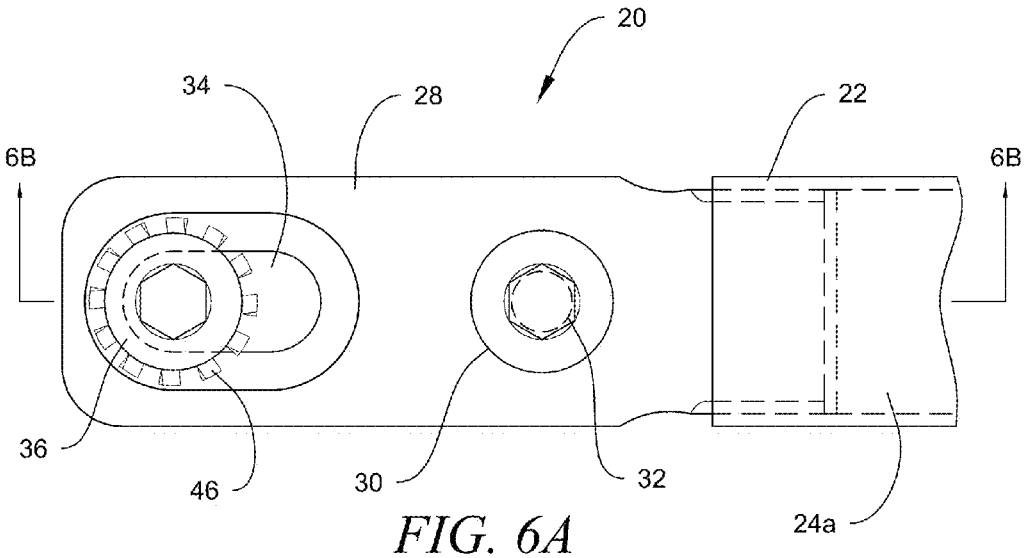
FIG. 6A is a close up view of the follow end of the insert of FIG. 3.

FIG. 6A is a close up view of the follow end 28 of the insert 20 of FIG. 3. Follow end 28 is inserted within sleeve 22 and welded in place to seal sleeve 22. Tapped hole 32 and smooth bore hole 34 are shown with placement bolt 30 and securing bolt 36 respectively. Smooth bore hole 34 is shown as a slotted bore to compensate for any alignment issues once insert 20 is installed in recess 14.

Figure 6B:
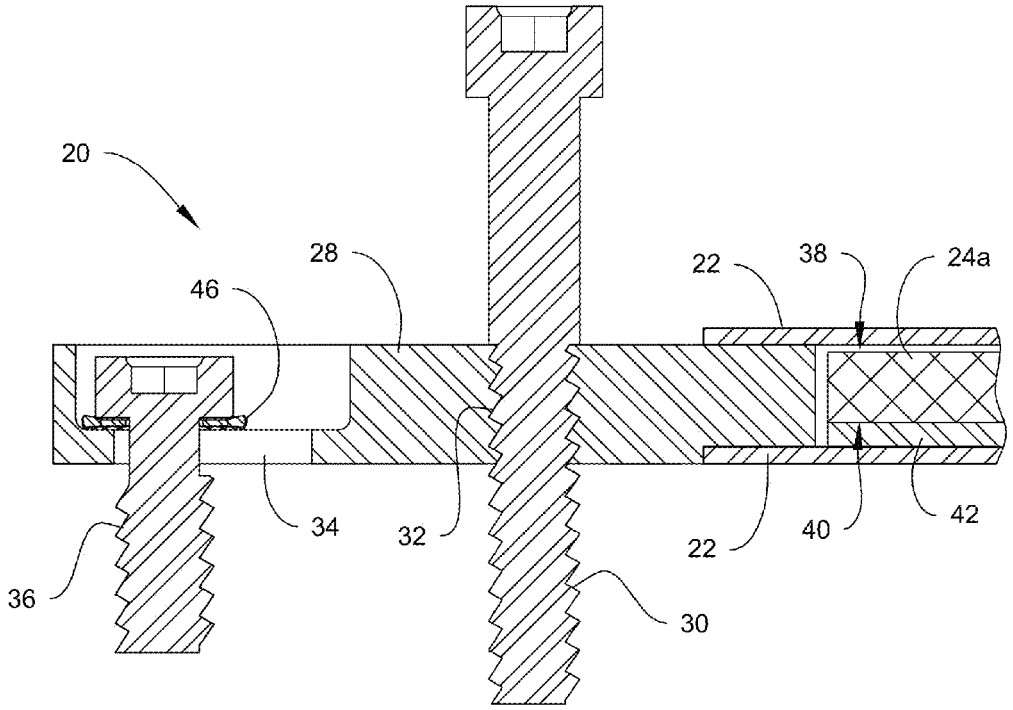
FIG. 6B is a close up view of the follow end of the insert of FIG. 4.

FIG. 6B is a sectional view of the follow end 28 of the insert 20 of FIG. 6A. In sectional view it is easier to see the tapped hole 32 and smooth bore 34. Magnets 24 and pole piece 42 are also shown within sleeve 22 which may be of various width, length and height dimensions depending on the width, length and thickness of magnets 24 installed within the sleeve and whether the magnets 24 consist of two or more magnets 24 that are stacked on top of each other with the magnetic north and south poles of the stacked magnets 24 facing and contacting each other to create a thicker, more powerful magnet circuit as compared to a thinner single magnet 24 or thinner stack of magnets 24 with the thickness of magnets 24 or stack of magnets 24 being level across the entirety of the north and south poles for a consistent magnetic circuit from end to end within the sleeve 22.

Figure 7A:
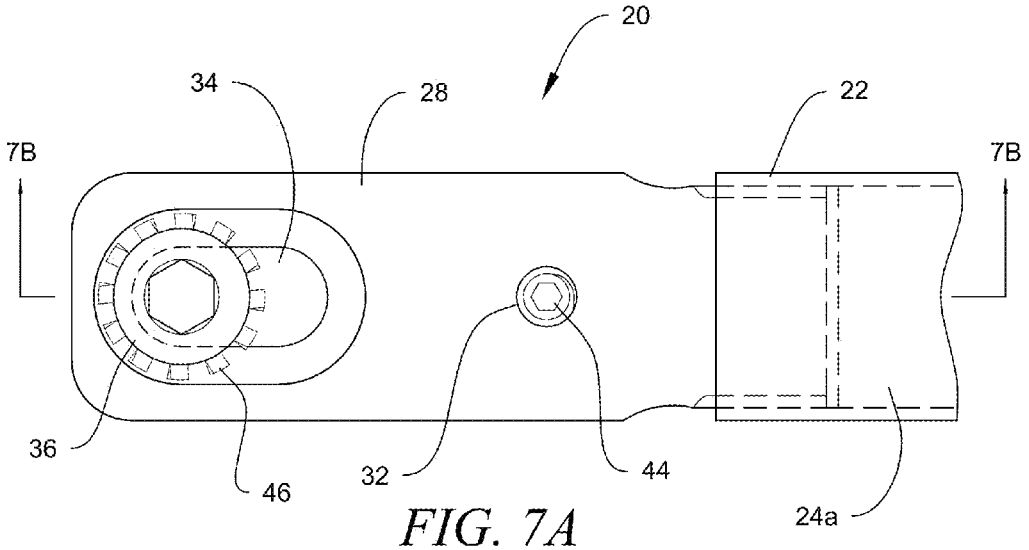
FIG. 7A is a close up view of the follow end of the insert of FIG. 3 with a set screw.

FIG. 7A is a close up view of the follow end 28 of the insert 20 of FIG. 3 with a set screw 44. Follow end 28 is inserted within sleeve 22 and welded in place to seal sleeve 22. Tapped hole 32 and smooth bore hole 34 are shown with set screw 44 and securing bolt 36 respectively. Smooth bore hole 34 is shown as a slotted bore to compensate for any alignment issues once insert 20 is installed in recess 14. Set screw 44 prevents debris build up in threaded bore 32 so that placement bolt 30 may be inserted more easily after tool 10 has been deployed. Set screw 44 may also be tightened to provide additional tension on securing bolt 36 once insert 20 is secured in tool 10. Washer 46 and set screw 44 may both be used to lock securing bolt 36 into place, or only one may be used or neither may be used.

Figure 7B:
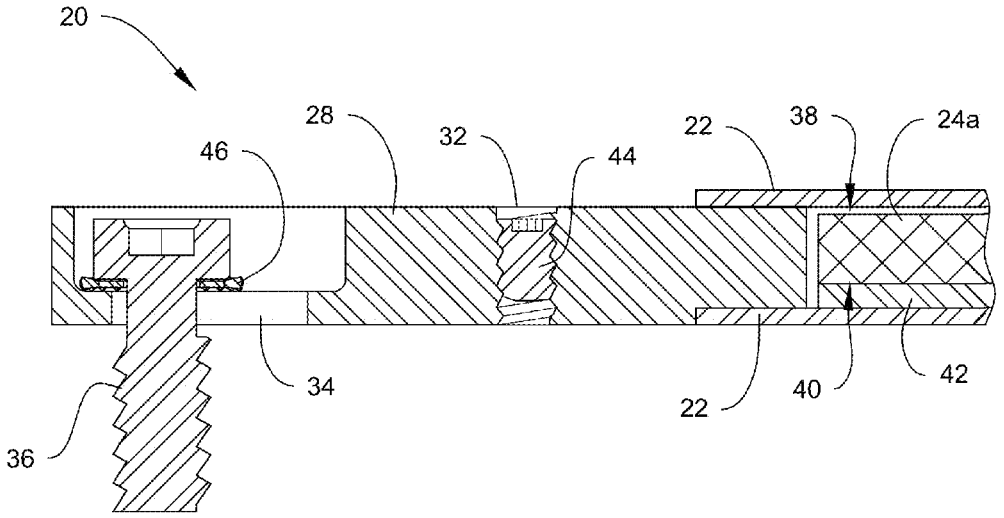
FIG. 7B is a close up view of the follow end of the insert of FIG. 4 with a set screw.

FIG. 7B is a close up view of the follow end 28 of the insert 20 of FIG. 4 with a set screw 44. In sectional view it is easier to see the tapped hole 32 and smooth bore 34. Magnets 24 and pole piece 42 are also shown within sleeve 22. Set screw 44 is shown in threaded bore 32.

It should be apparent from the foregoing that an invention having significant advantages has been provided. While the invention is shown in only a few of its forms, it is not just limited but is susceptible to various changes and modifications without departing from the spirit thereof.

I claim:

1. A magnetic insert for a magnetic tool used in a well, the insert comprising:

a tubular sleeve with a first end and a second end opposite the first end, an outwardly facing top surface and an inwardly facing bottom surface;

a lead end securely attached to the first end;

a follow end securely attached to the second end;

a plurality of magnets within the sleeve, each magnet having a north pole and an opposite south pole, the magnets arranged in the sleeve such that each magnet has the same pole directed towards the top surface; and the follow end having a smooth bore for receiving a securing bolt and a threaded bore for receiving a placement bolt wherein;

the tubular sleeve is formed of magnetic steel; and the lead end and follow end are formed of non-magnetic steel.

2. The insert of claim 1 wherein:

the lead end and follow end are welded to the tubular sleeve to seal the sleeve.

3. A magnetic insert for a magnetic tool used in a well, the insert comprising:

a tubular sleeve with a first end and a second end opposite the first end, an outwardly facing top surface and an inwardly facing bottom surface;

a lead end securely attached to the first end;

a follow end securely attached to the second end;

a plurality of magnets within the sleeve, each magnet having a north pole and an opposite south pole, the magnets arranged in the sleeve such that each magnet has the same pole directed towards the top surface; and the follow end having a smooth bore for receiving a securing bolt and a threaded bore for receiving a placement bolt further comprising:

a magnetic pole piece that runs most of the length of the sleeve between the magnets and the inwardly facing bottom surface of the sleeve.

4. A tool for removing metal from a well, the tool comprising:

a body having a connector at a top end of the body and a plurality of recesses about a perimeter of the body, each recess having a tool tab at one end;

a plurality of magnetic inserts sized to fit the recesses, each insert comprising:

a tubular sleeve with a first end and a second end opposite the first end, an outwardly facing top surface and an inwardly facing bottom surface;

a lead end securely attached to the first end;

a follow end securely attached to the second end;

a plurality of magnets within the sleeve, each magnet having a north pole and an opposite south pole, the magnets arranged in the sleeve such that each magnet has the same pole directed towards the top surface; and the follow end having a smooth bore for receiving a securing bolt and a threaded bore for receiving a placement bolt.

5. The tool of claim 4 wherein:

the body and tubular sleeve are formed of magnetic steel; and the lead end and follow end are formed of non-magnetic steel.

6. The tool of claim 5, wherein:

the lead end and follow end are welded to the tubular sleeve to seal the sleeve.

7. The tool of claim 4 further comprising:

a magnetic pole piece that runs most of the length of the sleeve between the magnets and the inwardly facing bottom surface of the sleeve.

8. A method for safely securing and removing magnetic inserts from a magnetic tool used in a well, the method comprising:

providing a tool having:

a body having a connector at a top end of the body and a plurality of recesses about a perimeter of the body, each recess having an associated tool tab at one end of the recess and an associated threaded tool bore at the opposite end;

a plurality of magnetic inserts sized to fit the recesses, each insert comprising:

a tubular sleeve with a first end and a second end opposite the first end, an outwardly facing top surface and an inwardly facing bottom surface;

a lead end securely attached to the first end;

a follow end securely attached to the second end;

a plurality of magnets within the sleeve, each magnet having a north pole and an opposite south pole, the magnets arranged in the sleeve such that each magnet has the same pole directed towards the top surface; and the follow end having a smooth bore for receiving a securing bolt, and a threaded bore for receiving a placement bolt;

threading a placement bolt through the threaded bore in the follow end of a first magnetic insert;

placing the lead end of the first insert under a first tool tab while holding the follow end of the first insert away from the tool;

moving the follow end of the insert towards the recess associated with the first tool tab until the placement bolt is within the recess;

unscrewing the placement bolt to lower the sleeve into the recess of the tool;

unscrewing the placement bolt from the threaded hole completely; and placing a securing bolt through the smooth bore of the follow end of the insert into the threaded tool bore associated with the first tool tab.

9. The method of claim 8 wherein:

the body and tubular sleeve are formed of magnetic steel; and the lead end and follow end are formed of non-magnetic steel.

10. The method of claim 9 wherein:

the lead end and follow end are welded to the tubular sleeve to seal the sleeve.

11. The method of claim 8 further comprising:

a magnetic pole piece that runs most of the length of the sleeve between the magnets and the inwardly facing bottom surface of the sleeve.

* * * * *